US006498490B2

(12) United States Patent
Karau et al.

(10) Patent No.: US 6,498,490 B2
(45) Date of Patent: Dec. 24, 2002

(54) ION SENSE IGNITION BIAS CIRCUIT

(75) Inventors: Philip Allen Karau, Grand Blanc, MI (US); Philip Ralph Peterson, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/845,377

(22) Filed: Apr. 30, 2001

(65) Prior Publication Data

US 2002/0000809 A1 Jan. 3, 2002

Related U.S. Application Data

(60) Provisional application No. 60/214,568, filed on Jun. 28, 2000.

(51) Int. Cl.[7] ..... F02P 17/00
(52) U.S. Cl. ..... 324/380
(58) Field of Search ..... 324/380, 382, 324/391, 464; 123/653, 655, 644

(56) References Cited

U.S. PATENT DOCUMENTS 5,107,701 A * 4/1992 Smith ..... 73/119 A
5,801,534 A * 9/1998 Hohner et al. ..... 324/399
6,025,844 A 2/2000 Parsons
6,075,366 A 6/2000 Yasuda
6,118,276 A 9/2000 Nakata et al.
6,145,491 A 11/2000 Wilstermann et al.
6,151,954 A 11/2000 Aoki et al.
6,185,500 B1 2/2001 Ketterer et al.
6,186,129 B1 2/2001 Butler et al.
6,196,054 B1 3/2001 Okamura et al.
6,202,474 B1 3/2001 Takahashi et al.

* cited by examiner

*Primary Examiner*—N. Le
*Assistant Examiner*—Etienne P LeRoux
(74) *Attorney, Agent, or Firm*—Vincent A. Cicnosz

(57) ABSTRACT

Disclosed is a bias and measuring circuit that improves the ion sense measurement and ignition performance of an Ion Sense Ignition system where the ion current signal processing is implemented remote from the ignition coil. Specifically, the bias and measuring circuit of the invention reduces the effects of secondary harness capacitance on the ion current signal, minimizes the effects of harness electrical leakage and reduces the chances for "spark-on-make" (an ignition firing when the ignition coil primary is initially energized).

10 Claims, 1 Drawing Sheet

ION SENSE IGNITION BIAS CIRCUIT

CROSS-REFERENCE TO RELATED APPLICATIONS

This application claims the benefit of U.S. provisional application No. 60/214,568, filed Jun. 28, 2000 the contents of which are incorporated by reference herein in their entirety.

BACKGROUND

Ion sense ignition has been in limited use in automotive engines for several years, and has recently started to appear in more applications, driven in part by regulated on-board diagnostic requirements. Ion Sense systems measure the presence of ions or free electrons in the engine's combustion chamber by electrically biasing the gap of the spark plug with a voltage. The current flow induced by the applied bias voltage is a measure of the ion or free electron density in the cylinder. The ion or free electron density is related to the chemistry of the fuel and the combustion process itself. It has been clearly demonstrated that Ion Sense Ignition systems can be used to detect and measure combustion (or misfire) and engine knock as well as the cylinder location of peak pressure, air to fuel ratio and other combustion characteristics.

BRIEF SUMMARY

Disclosed is a bias and measuring circuit that improves the ion sense measurement and ignition performance of an ion sense ignition system where the ion current signal processing is implemented remote from an ignition coil. The circuit comprises an energy storage device connected in series with a spark gap and an ignition coil secondary winding. A spark current from the ignition coil charges the energy storage device, where the energy storage device acts as an ion current generating source. A voltage control device connected in parallel with the energy storage device, limits a voltage to be charged onto the energy storage device to within a specified value. A diode in series with the voltage control device and a resistor connected in parallel with the diode direct the current flow.

A second resistor is connected in series with the first resistor, via an electrical harness wire, a voltage across which corresponds to a measured ion current. A second voltage control device is connected in parallel with the second resistor, to allow a selected magnitude of voltage to be generated across the second resistor by the ion current without voltage limiting.

The bias and measuring circuit disclosed reduces the effects of secondary harness capacitance on the ion current signal, minimizes the effects of harness electrical leakage and reduces the chances for "spark-on-make" (an ignition firing when the ignition coil primary is initially energized).

BRIEF DESCRIPTION OF THE DRAWINGS

The present invention will now be described, by way of an example, with references to the accompanying drawings, wherein like elements are numbered alike in the several figures in which.

DETAILED DESCRIPTION OF AN EXEMPLARY EMBODIMENT

Figure 1:
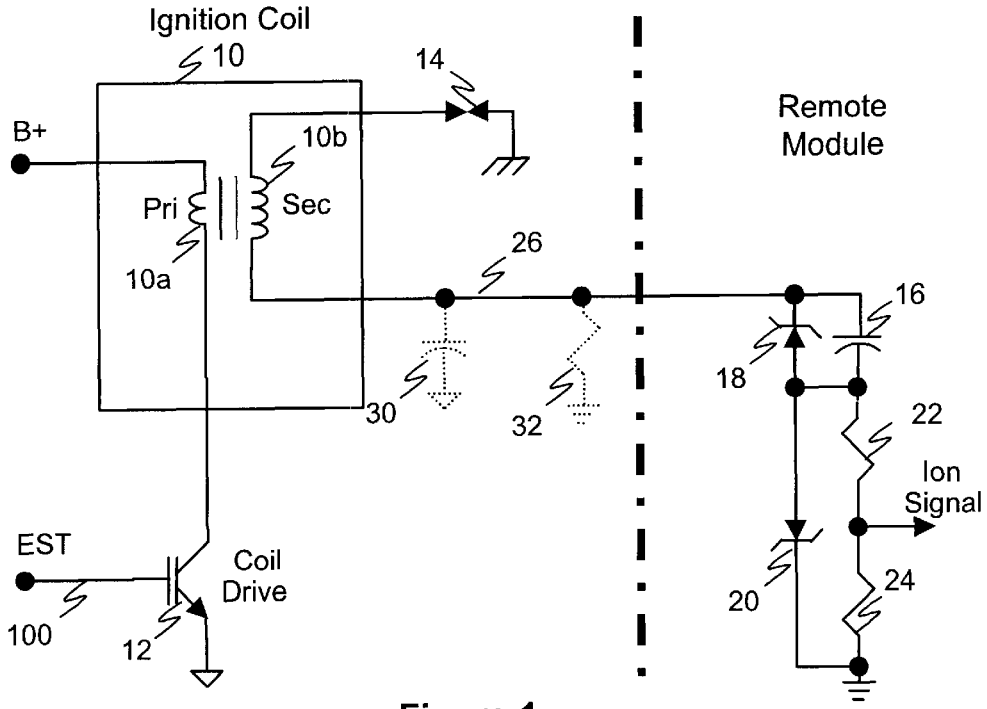
FIG. 1 depicts a schematic of an Ion Sense bias and measurement circuit in a known arrangement.

Referring to FIG. 1, an existing Ion Sense bias and measurement circuit is depicted as part of an ignition system. The system represents an inductive ignition system with an ignition coil for each spark plug of an internal combustion, spark ignition engine. Such an ion sense circuit is described in U.S. Pat. Ser. No. 6,118,276 dated Sep. 12, 2000 and may be referred to for reference.

An exemplary embodiment defines bias and measuring circuit enhancements that significantly improve the ignition and ion current measurement capabilities of an Ion Sense system. The disclosed embodiments may be utilized in various types of engines or apparatus employing electronic ignition systems. A preferred embodiment of the invention, by way of illustration is described herein as it may be applied to an automobile employing an ion sense ignition system. While a preferred embodiment is shown and described by illustration and reference to an automobile ignition system, it will be appreciated by those skilled in the art that the invention is not limited to the automobiles alone by may be applied to all engines and apparatus employing electronic ignition systems or ion sense ignition systems.

Referring again to FIG. 1, an existing ion sense ignition system is depicted. The ignition coil 10 includes, but need not be limited to, primary winding 10*a* and secondary winding 10*b* operationally connected and configured to transmit electrical energy from the primary winding 10*a* to the secondary winding 10*b* or vice versa. The ignition coil 10 is a transformer with a turns ratio N from the secondary winding 10*b* to the primary winding 10*a*. One side of the primary winding 10*a* of ignition coil 10 is connected to a power supply hereinafter denoted (B+). The other side of the primary winding 10*a* of the ignition coil 10 is connected to a coil driver 12. The coil driver 12 is a controllable switching device for example a transistor, switch, relay, and the like including combinations of the foregoing.

The high voltage side of the secondary winding 10*b* of ignition coil 10 is connected to a spark gap 14, for example a spark plug and the like. The low voltage side of the secondary winding 10*b* is connected to the ion sense bias and measurement circuit, which includes, but is not limited to a first voltage control device 18, a second voltage control device 20 energy storage device 16, a first resistor 22 and a second resistor 24. The first voltage control device 18, a second voltage control device 20 may comprise a variety of components including but not limited to a zener diode, transistor, shunt regulator, and the like, including combinations of the foregoing.

An Electronic Spark Timing (EST) signal 100 is generated by an engine control module (not shown) and supplied to the coil driver 12. When the EST signal is at a high state, coil driver 12 turns on (activates), thereby connecting the primary winding 10*a* to ground and enabling the current conduction through the primary winding 10*a* of ignition coil 10 and facilitating the charging thereof When the ignition coil 10 primary winding 10*a* has been appropriately charged, the EST signal switches low and coil driver 12 turns off. Through commonly understood electrodynamic means, a large voltage is produced across the primary winding 10*a* and therefore a large voltage (typically 30,000 to 40,000 volts potential) across the secondary winding 10*b* of the ignition coil 10. Such a large potential breaks down the spark gap 14 thereby creating an arc and thus, a spark to ignite the air/fuel mixture.

In the abovementioned configuration, the polarities of the ignition coil windings (10*a* and 10*b*) and electrical connections are arranged such that the voltage induced in the secondary winding 10*b* of the ignition coil 10 and the spark gap 14 exhibits a negative voltage polarity with respect to ground. Therefore, once again in reference to FIG. 1, the path for the spark current is characterized as: from ground, through the spark gap 14; through the secondary winding 10*b* of the ignition coil 10; through the electrical harness wire 26; through energy storage device 16 and the forward biased (e.g., anode to cathode) second voltage control device 20; and finally returning to ground. The spark current will quickly charge energy storage device 16 to the breakdown voltage of a first voltage control device 18. Once energy storage device 16 is charged to this voltage, spark current then flows through the first voltage control device 18 and the forward biased second voltage control device 20 to ground. Energy storage device 16 is thus charged to a known voltage and thereby, becomes the bias voltage source for ion current measurements.

Once the energy in the ignition coil 10 is dissipated and the spark current stops flowing, the voltage of charged energy storage device 16 is applied to the spark gap 14 via the secondary winding 10*b* of the ignition coil 10. If ions or free electrons are present in the environment ambient to the spark gap, "ion" current will flow as follows: from ground, through the second resistor 24 and the first resistor 22; through energy storage device 16; through the electrical harness wire 26; to the secondary winding 10*b* of the ignition coil 10 and the spark gap 14 and finally to ground. This current flow produces a negative voltage across the second resistor 24, which represents the ion current flow and may be sensed as the Ion Signal and measured and/or processed by subsequent means (not shown) for detecting the ion current such as a remote module, processing circuit, or computer.

The functions of each of the identified components is as follows: the first voltage control device 18 establishes and "regulates" the ion sense bias voltage across energy storage device 16, and provides a path for the spark current once energy storage device 16 is charged. Moreover, the first voltage control device 18 in conjunction with the second voltage control device 20 limits the voltage of the low side of the secondary winding 10*b* of the ignition coil 10 in both positive a negative directions to protect the bias circuitry. The second voltage control device 20 also provides a path for the spark current, and limits the voltage across the series combination of the first resistor 22 and the second resistor 24 to protect the bias circuitry and subsequent connected signal processing or detection circuitry from potentially damaging over-voltage conditions. The regulation voltage value of the second voltage control device 20 is selected to allow the maximum ion current signal to be applied to the series connection of first resistor 22 and second resistor 24 without limiting the range of ion current measurement. For example, the regulation voltage value of the second voltage control device 20 is selected to be just larger than the voltage produced in the series combination of the first resistor 22 and the second resistor 24 by the maximum expected ion current.

Energy storage device 16 provides the bias voltage source for ion current measurement. It is charged by the spark current as described previously. The value of energy storage device 16 is selected to ensure that the bias voltage applied to the spark gap 14 remains relatively constant during the engine cylinder cycle. For example, the capacity of the energy storage device is selected to ensure that the bias voltage does not droop more than 10%–15% over the duration that the ion current is being measured. Second resistor 24 converts the ion current signal to a voltage per well-understood principles, namely Ohm's law. The resistance value of the second resistor 24 is selected to provide a voltage magnitude suitable for the circuitry that will process the ion current signal. For example, the second resistor 24 may be selected to ensure that a sufficiently large voltage is induced by the ion current flow to avoid noise susceptibility or detection errors.

Similarly, the first resistor 22 is employed to reduce the voltage amplitude of electrical noise that may be found in the ion sense signal circuitry by an understood voltage divider principle ($Vout=Vin \times R2/(R1+R2)$ where Vout is the resultant voltage supplied as the Ion signal proportional the ion current, Vin is the voltage across the series combination of the first resistor 22 and the second resistor 24, R1 is an annotation for the first resistor 22, and R2 is an annotation for the second resistor 24. The resistance value of the first resistor 22 is commonly selected to be about ten times the resistance value of the second resistor 24.

Figure 2:
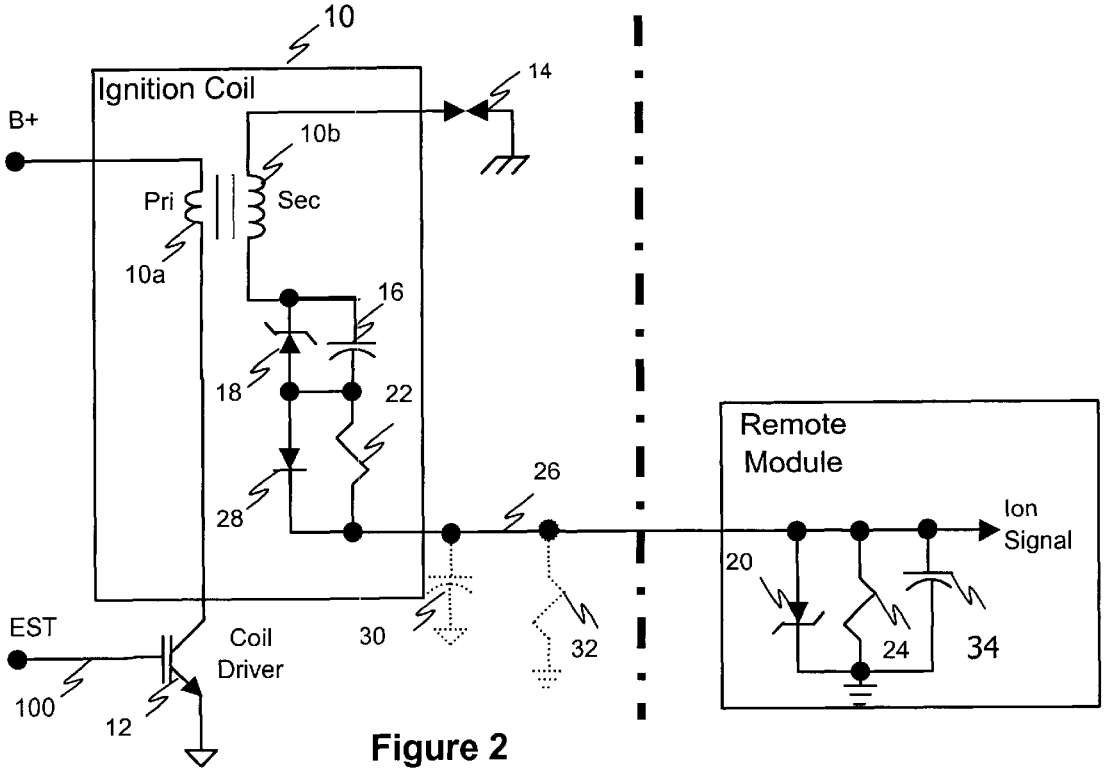
FIG. 2 depicts a schematic of a preferred embodiment.

Referring to FIG. 2, the bias and measurement circuit of an exemplary embodiment is depicted. An exemplary embodiment, preferentially locates selected bias and measurement circuit components as introduced in the above-mentioned description with or in close proximity to the ignition coil 10 as well as within the module in which ion current signal processing is to be done. For example, selected components may be collocated with the ignition coil 10 or integrated into the packaging with the ignition coil 10. Such a configuration enhances the overall operation of the bias and measurement circuit by minimizing the effects of secondary circuit capacitance and leakage. Moreover, inadvertent "spark on make" ignitions are reduced over previous circuit configurations including the abovementioned configuration as depicted in FIG. 1, by establishing increased impedance in the ion current bias circuit path.

The bias and measurement circuit of an exemplary embodiment includes, but is not limited to the circuit components described earlier reconfigured as depicted. Specifically, with reference to FIG. 1 as well, the first voltage control device 18, energy storage device 16, and the first resistor 22 are relocated to close proximity of the low side of the secondary winding 10*b* of the ignition coil 10. Additionally, a diode 28 is included to provide a low impedance path for the spark current, effectively shunting the first resistor 22 in the spark current direction, yet impeding bias or ion current flow by forcing it through the first resistor 22. The second voltage control device 20 has been repositioned to be collocated with the module or circuitry receiving the ion signal and placed in parallel with the second resistor 24. Once again, for the second voltage control device 20 and second resistor 24, placement at or in close proximity to the to the module or circuitry receiving the ion signal is preferred. Because of its change in configuration, the voltage "regulation" value of the second voltage control device 20 is adjusted to once again perform the circuitry protection and limiting functions as described previously. Optionally, a second energy storage device 34 may be employed across the second resistor 24 and second voltage regulation device to provide additional filtering, thereby enhancing measurement of the Ion signal.

The exemplary embodiment reconfigures the known bias and measurement circuit of FIG. 1 in a manner that places the distributed secondary capacitance 30 and any leakage depicted as leakage impedance 32 between the first resistor 22 and the second resistor 24. Moreover, by virtue of the depicted circuit configuration, it is evident that the distributed secondary capacitance and any leakage is further placed between the first voltage control device 18 (or diode 28 for that matter) and the second voltage control device 20. Moreover, it will be appreciated by those skilled in the art that the series configuration of the parallel pairs comprising;

first, the first voltage control device 18 and energy storage device 16, or secondly, the diode 28 with the first resistor 22, may be interchanged without impact.

In an implementation of the exemplary embodiment as depicted in FIG. 2 as well as in the existing bias and measurement circuit of FIG. 1, zener diodes are utilized as the first voltage control device 18 and the second voltage control device 20, providing both voltage control and regulation as well as reverse current conduction under certain conditions. Moreover, a capacitor is employed as the energy storage device 16. However, it will be apparent that the energy storage device 16 may comprise a variety of energy storing elements including a capacitor, battery, inductor, and the like, including combinations of the foregoing. A capacitor may be preferred as it is readily adapted to the desired functionality. Finally, it will be apparent that the first resistor 22 and a second resistor 24 combined in series operate to perform both current limiting and voltage division functions.

The exemplary embodiment may now be described and illustrated by way of associated features and advantages realized with the disclosed measurement and bias circuit of FIG. 2. Description of the generation of spark current and bias current is similar to that described earlier with FIG. 1 and is omitted to avoid repetition. The exemplary embodiment, as depicted in FIG. 2 minimizes the delay in true ion current measurement after the ignition spark ends. A characteristic of ion current detection is that after the spark current diminishes or ends, a voltage will remain on a distributed capacitance of the secondary. The distributed secondary capacitance ($C_{sec}$) 30 is an equivalent combination of the capacitive effects resultant from ignition coil 10 secondary winding 10*b* parasitic effects, secondary circuit elements, harnessing, and the like, including combinations of the foregoing.

In the measurement and bias circuits depicted, this residual voltage is negative. Referring to FIG. 1, circuit analysis indicates that this will create the appearance of ion current as the distributed secondary capacitance ($C_{sec}$) 30 is charged by the bias energy storage device 16 through first resistor 22 and second resistor 24. It is noteworthy to appreciate that, practically, the capacitance of energy storage device 16 is typically orders of magnitude larger than that of $C_{sec}$ 30. However, the charge accumulated on $C_{sec}$ 30 should be quickly dissipated to ensure that accurate ion current measurements may be made, and no real ion current signal lost. The time to dissipate the charge on the distributed secondary capacitance ($C_{sec}$) 30 is proportional to the time constant of the circuitry associated with $C_{sec}$ 30.

In FIG. 1, assuming that the effective impedance of the spark gap 14 is large with respect to the impedance of first resistor 22, the time constant to dissipate the charge on the distributed secondary capacitance 30 is $C_{sec}\times(R1+R2)$, where $C_{sec}$ is the distributed secondary capacitance 30, R1 denotes the resistance value of the first resistor 22, and R2 denotes the resistance value of the second resistor 24. In the exemplary embodiment as depicted in FIG. 2, it may be seen that the time constant associated with the distributed secondary capacitance 30 is $C_{sec}\times R2$. Once again, as described previously, the first resistor 22 is commonly 10 times the value of the second resistor 24. Therefore, employing the exemplary embodiment of FIG. 2, the delay after spark until an accurate ion current signal is available has been reduced by more than 10: 1.

Minimizing the delay in ion current measurement after the spark ends may be of further benefit when addressing additional secondary voltage characteristics. As the ignition spark ends, the secondary voltage of the ignition coil 10 "rings" producing a high frequency, high amplitude, oscillating AC voltage. This ringing is understood to be due to the characteristics of the ignition coil 10 (or any inductive coil for that matter) and the circuitry interfaced to the secondary winding 10*b*. Such ringing is an additional phenomenon, which may obscure an ion current or the measurement thereof, further delaying the time at which useful ion current measurement may begin. Once again, the exemplary embodiment as discussed above minimizes this problem by co-locating the first resistor 22 with the ignition coil 10, thus limiting the dynamic characteristics thereof.

Additionally, it may be appreciated, that by including a second energy storage device 34 to the bias and measurement circuit, in parallel with the second voltage control device 20, the overall secondary circuit can be tuned to minimize the ring-out time and thus further reducing the delay after spark until ion current can be accurately measured.

Once again, under certain engine operating conditions, pre-ignition or knock may be observed in the ion current. In an ion sense system, knock manifests itself as a low amplitude AC modulation of the ion current signal. Its first mode component is typically in the range of 5 to 10 KHz for automotive applications. The modulation of the ion current may be detected and utilized to evaluate engine performance. Referring to FIG. 1, the distributed secondary capacitance $C_{sec}$ 30, in conjunction with the input impedance of the bias and measuring circuit, may act as a first order filter for any AC signal. As in the previous discussion relative to ion current signal delay, the time constant of this resultant first order filter for the bias and measurement circuit of FIG. 1 is effectively $C_{sec}\times(R1+R2)$ where $C_{sec}$ is the distributed secondary capacitance 30, R1 is the resistance value of the first resistor 22, and R2 likewise, is the resistance value of the second resistor 24.

However, the bias and measurement circuit of the exemplary embodiment as depicted in FIG. 2 results in a modification of the filtering time constant to $C_{sec}\times R2$, once again a reduction of more than 10: 1. Therefore, depending on the exact parameters of a given application, the modified bias and measurement circuit depicted in FIG. 2 provides such a reduction in time constant, and may result in an improvement in the fidelity of the knock information in the ion current signal. This improvement is achieved via increased amplitude of the knock information relative to other components in the ion current.

Moreover, the reconfiguration of the ion sense and bias measurement circuit as depicted in the exemplary embodiment of FIG. 2 essentially eliminates the effects of external electrical leakage. In the bias and measurement circuit of FIG. 1, the bias voltage of energy storage device 16 is applied to the electrical harness wire 26 connecting the bias and measurement circuit with the secondary winding 10*b* of the ignition coil 10. Therefore, if an electrical leakage path develops from this electrical harness wire to some other electrical point on the engine or vehicle, a current will flow. Such an electrical leakage might occur in a production automotive system due to aging of components, damage to components, contamination, during repair, or inspection of the electrical system or similar conditions. Electrical leakage may be represented by a leakage impedance ($Z_{leak}$) 32 depicted from the electrical harness wire 26 to ground. Leakage current, therefore, would be equal to $V_{bias}/Z_{leak}$. Since this current is due to and proportional to the bias voltage of energy storage device 16, the current also appears as a voltage across the second resistor 24, and is measured as ion current. However, this is false ion current, and can make detection of misfire extremely difficult.

In the exemplary embodiment as depicted in FIG. 2, the bias voltage does not appear on the electrical harness wire connecting the second resistor 24 and the ignition coil 10 located bias circuitry. Therefore, electrical harness leakage due to the bias voltage is not generated and cannot cause "false" ion current. The only effect of electrical leakage to ground in the exemplary embodiment is to slightly reduce the measured ion current through the second resistor 24. This is because the leakage resistance 32 appears as a resistor in parallel with the second resistor 24 dividing the ion current between leakage resistor 32 and second resistor 24 due to well-understood principles. However, since the leakage resistance 32 is typically orders of magnitude larger than the value of the second resistor 24, the effect on measured ion current is less than about 1%.

The primary function of an ignition system is to create a spark at the proper time and of sufficient energy to ignite the air/fuel mixture in the cylinder. As stated earlier, this occurs when the coil driver 12 is switched off, creating a very large voltage across the primary winding 10*a* and, therefore, the secondary winding 10*b* of ignition coil 10. To those skilled in the art, it is understood that the possibility for generating a spark also exists when the coil driver 12 is switched on or activated to initially conduct current through the primary winding 10*a* of the ignition coil 10. Referring to FIG. 1, specifically, when the coil driver 12 is switched on, it connects a voltage essentially equal to the vehicle supply voltage (B+) across the primary winding 10*a* of ignition coil 10. This produces a peak secondary voltage defined as K×N×B+, where K is a constant, usually between 1 and 3 related to the specific static and dynamic characteristics of the ignition coil 10 inductive effects and the impedances of any circuitry interfaced to the secondary winding 10*b*, and N is the secondary winding 10*b* to primary winding 10*a* turns ratio of the ignition coil 10. With typical ignition characteristics, this "spark-on-make" secondary voltage may be as large as about 500 to about 2000 volts. A "spark-on-make" voltage has the potential to cause inadvertent arcing at the spark gap 14 and thus undesired ignition. As may be expected, the polarity of "spark-on-make" voltage is the opposite of spark voltage polarity.

In the exemplary embodiment, and the examples discussed, the "spark-on-make" voltage is denoted to have a positive polarity. In FIG. 1, the path for "spark-on-make" spark current is from ground, through the second voltage control device 20, then through the forward biased first voltage control device 18, the secondary winding 10*b* of ignition coil 10 and the spark plug gap 14 back to ground. This is a relatively low impedance path, which accentuates the dynamic characteristics of the ignition coil 10, resulting in an increase in the constant K described above. The increased constant K then produces an increased peak voltage induced at the secondary winding 10*b* of the ignition coil 10 thereby making the bias and measurement circuit of FIG. 1 susceptible to inadvertent "spark-on-make" ignition.

The exemplary embodiment significantly increases the impedance of the "spark-on-make" spark current path. In FIG. 2, the path for the "spark-on-make" spark current is from ground, through second voltage control device 20, the electrical harness wire 26, then through the first resistor 22, the forward biased first voltage control device 18, onto the secondary winding 10*b* of ignition coil 10 and then spark plug gap 14 back to ground. The relocation of the first resistor 22 in conjunction with the addition of diode 28 has been found to reduce the value of the constant K to about one in the equation above, thus reducing the peak secondary voltage generated at coil driver 12 turn-on. Because the voltage generated during "spark-on-make" opposes diode 28, first resistor 22 limits the current flow. Therefore, first resistor 22 operates in conjunction with any stray capacitance associated with the interfaces to the spark gap 14 acting as a "filter," which limits the ability of the "spark-on-make" secondary voltage to rise to levels sufficient to induce an inadvertent ignition.

Furthermore, even if a "spark-on-make" current is generated in spite of the reduced K values, the "spark-on-make" current is greatly limited by the first resistor 22. This significantly reduces the energy of any spark produced, and further minimizes the chance for producing inadvertent ignition.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An ion current sense ignition bias circuit comprising:

an energy storage device operatively connected in series with a spark gap and an ignition coil secondary winding, said energy storage device charged by a spark current of said ignition coil secondary winding said energy storage device acting as an ion current generating source;

a first voltage control device operatively connected in parallel with said energy storage device, said first voltage control device limiting a voltage to be charged onto said energy storage device by said spark current to within a specified value;

a diode in series with said first voltage control device;

a first resistor operatively connected in parallel with said diode;

said energy storage device, said first voltage control device, said diode, and said first resistor are located in proximity to said ignition coil secondary winding;

a second resistor operatively connected in series with said first resistor, via an electrical harness wire, a voltage across which corresponds to a measured ion current;

a second voltage control device operatively connected in parallel with said second resistor, said second voltage control device oriented and configured allow a selected magnitude of voltage to be generated across said second resistor by said ion current without voltage limiting; and said second resistor and said second voltage control device located in proximity with a remote module for measurement and processing of said measured ion current.

2. The circuit of claim 1 wherein said energy storage device, said first voltage control device, said diode, and said first resistor are integrated into said ignition coil.

3. The circuit of claim 1 wherein said second voltage control device and said second resistor are integrated into said remote module.

4. The circuit of claim 1 wherein said electrical wire harness separates said diode and first resistor from said second voltage control device and said second resistor.

5. The circuit of claim 1 wherein said first voltage control device is a zener diode.

6. The circuit of claim 1 wherein said second voltage control device is a zener diode.

7. The circuit of claim 1 further including a second energy storage device, said second energy storage device operatively connected in parallel with said second resistor.

8. The circuit of claim 7 wherein said second energy storage device is sized and configured to provide filtering of said measured ion current.

9. The circuit of claim 7 wherein said second energy storage device is a capacitor.

10. An ion current sense ignition bias circuit comprising:

an energy storage device operatively connected in series with a spark gap and an ignition coil secondary winding, said energy storage device charged by a spark current of said ignition coil secondary winding said energy storage device acting as an ion current generating source;

a first voltage control device operatively connected in parallel with said energy storage device, said first voltage control device limiting a voltage to be charged onto said energy storage device by said spark current to within a specified value;

a diode in series with said first voltage control device;

a first resistor operatively connected in parallel with said diode;

said energy storage device, said first voltage control device, said diode, and said first resistor are located in proximity to said ignition coil secondary winding;

a second resistor operatively connected in series with said first resistor, via an electrical harness wire, a voltage across which corresponds to a measured ion current;

a second voltage control device operatively connected in parallel with said second resistor, said second voltage control device oriented and configured allow a selected magnitude of voltage to be generated across said second resistor by said ion current without voltage limiting;

said second resistor and said second voltage control device located in proximity with a remote module for measurement and processing of said measured ion current; and wherein said first resistor and said first voltage control device are located between said ignition coil secondary winding and a circuit leakage impedance.

* * * * *